United States Patent [19]

Maier

[11] 3,942,700

[45] Mar. 9, 1976

[54] SAFETY DEVICE FOR A FASTENING ELEMENT SETTING GUN

[75] Inventor: Elmar Maier, Feldkirch-Tisis, Austria

[73] Assignee: Hilti Aktiengesellschaft, Schaan, Liechtenstein

[22] Filed: Sept. 24, 1974

[21] Appl. No.: 508,881

[30] Foreign Application Priority Data

Sept. 27, 1973 Germany ..... 2348693

[52] U.S. Cl. ..... 227/8; 227/11

[51] Int. Cl.[2] ..... B25C 1/18

[58] Field of Search ..... 227/8, 10, 11

[56] References Cited

UNITED STATES PATENTS

| | | | |
|---|---|---|---|
| 2,501,362 | 3/1950 | Temple | 227/8 |
| 3,514,026 | 5/1970 | Dardick | 227/11 |
| 3,554,424 | 1/1971 | Newton | 227/8 |

*Primary Examiner*—Granville Y. Custer, Jr.
*Attorney, Agent, or Firm*—Toren, McGeady and Stanger

[57] ABSTRACT

A safety device for a setting gun used for driving fastening elements into a receiving material by means of an explosive charge, utilizes two arm swivel levers pivotally mounted on the forward end of the gun housing for locking the gun barrel out of the firing position. One arm of each lever forms a catch arranged to block the movement of the barrel into the firing position until the other arm presses against the receiving material and causes the lever to pivot, displacing the catch from its blocking position. Normally, the swivel levers are spring biased into position to prevent movement of the barrel into the firing position.

9 Claims, 2 Drawing Figures

SAFETY DEVICE FOR A FASTENING ELEMENT SETTING GUN

SUMMARY OF THE INVENTION

The present invention is directed to a setting gun used for driving fastening elements into a receiving material by means of an explosive charge and, more particularly, it concerns a safety device used on the gun to prevent movement of the gun barrel into the firing position. Normally, the gun barrel is displaceable axially into the firing position by pressing it against the receiving material and the safety device provides one or a number of elements which prevent the movement of the barrel into the firing position until the element is displaced from the path of the barrel.

Setting guns of the type mentioned above, are used to drive fastening elements, such as bolts, into hard receiving materials, such as concrete, steel and the like. As a fastening element penetrates into the receiving material, a volume of the material, corresponding to the penetrating shaft of the fastening element, is displaced primarily in the lateral direction. Considerable radial forces are produced and if a fastening element is set too close to the edge of a brittle receiving material, there is the possibility that the element will cause cracking in the edge zone of the material. If such cracking occurs as the fastening element is being driven in, the element may leave the receiving material at the edge zone travelling at a high rate of speed, because of the lack of guidance normally provided by the receiving material. Such a fastening element passing through a working area represents a serious hazard for the person handling the setting gun and for any other persons who might be working in the area.

Conventional setting guns which require only that the barrel be pressed against the receiving material for movement into the firing position are particularly dangerous, because it is possible to position the gun relative to the receiving material so that the barrel center is offset outwardly from the edge of the receiving material. In such a situation there is the risk that the bolt can be fired directly into the open space alongside the material.

To ensure that fastening elements are not placed too close to the edge of the receiving material, axially displaceable cylindrical pins have been used in the forward end of the housing in known guns as sensing or scanning elements, that is, they determine the presence of the receiving material in the region of the elements outwardly from the setting gun barrel. Each of the pins is connected to a push rod which is axially displaceable within the gun housing. In turn, the push rods are in contact with locking pins which are spring loaded in the driving direction. The locking pins are located in a head positioned on the rearward portion of the setting gun and the head is arranged to rotate relative to the housing. In the rest or non-firing position of the setting gun the locking pins protrude into the guide bores of the push rods positioned in the gun housing.

If all of the sensing elements are displaced rearwardly, for example, by being pressed against the receiving material, the push rods associated with the elements are also moved rearwardly and, in turn, move the locking pins against the spring force in the rearward direction by a similar amount. With the locking pins disengaged from the guide bores of the push rods, the head can be turned. After turning the head, the setting gun can be fired, provided the barrel is displaced into its rearward or firing position.

If the setting gun is positioned against the receiving material with its barrel too close to the edge of the receiving material, at least one of the sensing elements will be positioned outwardly from the material and thus will not have a surface against which it can be pressed. Though the barrel and any other sensing elements are moved rearwardly, the one displaced outwardly from the edge will not be displaced and, as a result, it will not be possible to fire the setting gun.

This multipart safety mechanism is very elaborate in its design and extremely susceptible to operating problems. The design, characterized by long pin guides and several thrust transfer points, leads to jamming of the sensing fingers or of the parts connected with them when there is the slightest fouling of the setting gun. Further, the push rods can be jammed if the setting gun is dropped during usual rough operation at a construction site, since even slight deformation of the gun housing is sufficient to damage the relatively long pushrod guides.

If the push rods should jam in the displaced rearward position, the setting gun could be fired without being pressed against the receiving material.

A general disadvantage of the known safety mechanism is that the barrel can be displaced rearwardly, that is, into its firing position, independent of the sensing elements.

Accordingly, it is possible if the firing mechanism is faulty, that a cartridge in the firing position can be set off without the sensing or scanning elements being depressed against the receiving material and, as a result, it is not possible to ensure a tight bearing of the gun on the receiving material.

With regard to the handling of the setting gun, the known safety mechanism has a number of other disadvantages. Such a setting gun must be operated with both hands. One hand serves to press the setting gun against the receiving material, while the other hand is needed to turn the head. In the trigger operated setting guns frequently used at the present time, which are equipped for one-hand operation, in order to retain the object to be fastened with the other hand, the use of such a safety mechanism is impractical.

Accordingly, the present invention is directed to the solution of the problem of providing a simple and trouble-free safety mechanism to prevent the positioning of a setting gun barrel too close to the edge of the receiving material.

Therefore, in accordance with the present invention, the sensing or safety elements are displaceable between a forward position and a rearward position and, in the forward position, each element has a catch which prevents the barrel from being displaced into its firing position.

When the setting gun is pressed against the receiving material, it is necessary that each of the elements be displaced so that the rearward path of the barrel is clear for movement into the firing position. The direct functional relationship between the sensing elements and the barrel permits a safety mechanism which consists of only a few parts and which is suitable for use in trigger operated setting guns.

The safety or sensing elements are preferably formed as two arm swivel levers pivotally mounted on the forward end of the housing, with one arm extending forwardly and providing the sensing action against the receiving material while the other arm extends radially inwardly toward the barrel axis and forms a locking catch. These swivel levers have the advantage that they can be formed as a single part so that additional transfer members and their bearings which are susceptible to operating difficulties, can be eliminated.

The length of the sensing fingers can be selected in accordance with the conditions to be experienced, so that the extent of the sensing range is variable. In this manner, it is possible to provide the setting gun with swivel levers having sensing fingers of a length adapted to the strength of the receiving material. The swivel levers can be pivoted with a smooth movement if they are mounted in slots formed in the forward end of the housing. The smooth movement of the swivel levers is made possible by the small bearing surfaces involved in this arrangement.

Another advantage of the arrangement of the swivel levers is that the relation of the pressing path of the swivel levers to the blocking path of the catch can be selected at random in a simple manner by the discretional arrangement of the fulcrum of the swivel levers.

A particularly advantageous locking or blocking of the barrel is obtained by providing a shoulder adjacent the muzzle end of the barrel and facing in the opposite direction from the firing direction so that the shoulder can be engaged by the swivel lever catch as the barrel attempts to move rearwardly into the firing position. Preferably, the shoulder is formed by a revolving collar located on the muzzle end of the barrel. It is also possible to provide axially extending grooves in the outer surface of the barrel so that each of the swivel lever catches or engages in one of the grooves. In such an arrangement, the forward end of the grooves, that is, the end closer to the muzzle end of the barrel, is provided with a shoulder-like surface.

To ensure that the barrel is displaced into the firing position when the swivel levers are pivoted out of the locking or blocking position, the catches are preferably displaced outwardly out of the path of movement of the outer contour of the shoulder.

Another feature of the invention is the provision of stops on the housing for limiting the pivotal movement of the swivel levers. This arrangement ensures an unhindered assembly and disassembly of the barrel, since the catches on the swivel levers can only move radially inwardly by a small amount toward the barrel axis.

To assure that the catches on the swivel levers are in position to provide a lock on the movement of the barrel into the firing position, a spring element is provided which returns the swivel levers into the blocking position after they have been pivotally displaced. In this way a vibration-free locking, free from play, is obtained. An expedient solution is obtained if the spring element is designed as a ring-shaped, closed tension spring. To protect the spring from damage, the swivel levers are provided with recesses in the arms which form the catches and the spring is inserted into the recesses under an initial stress so that it is protected from any damage from the exterior of the housing.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there is illustrated and described a preferred embodiment of the invention.

DETAILED DESCRIPTION OF THE INVENTION

Figure 1:
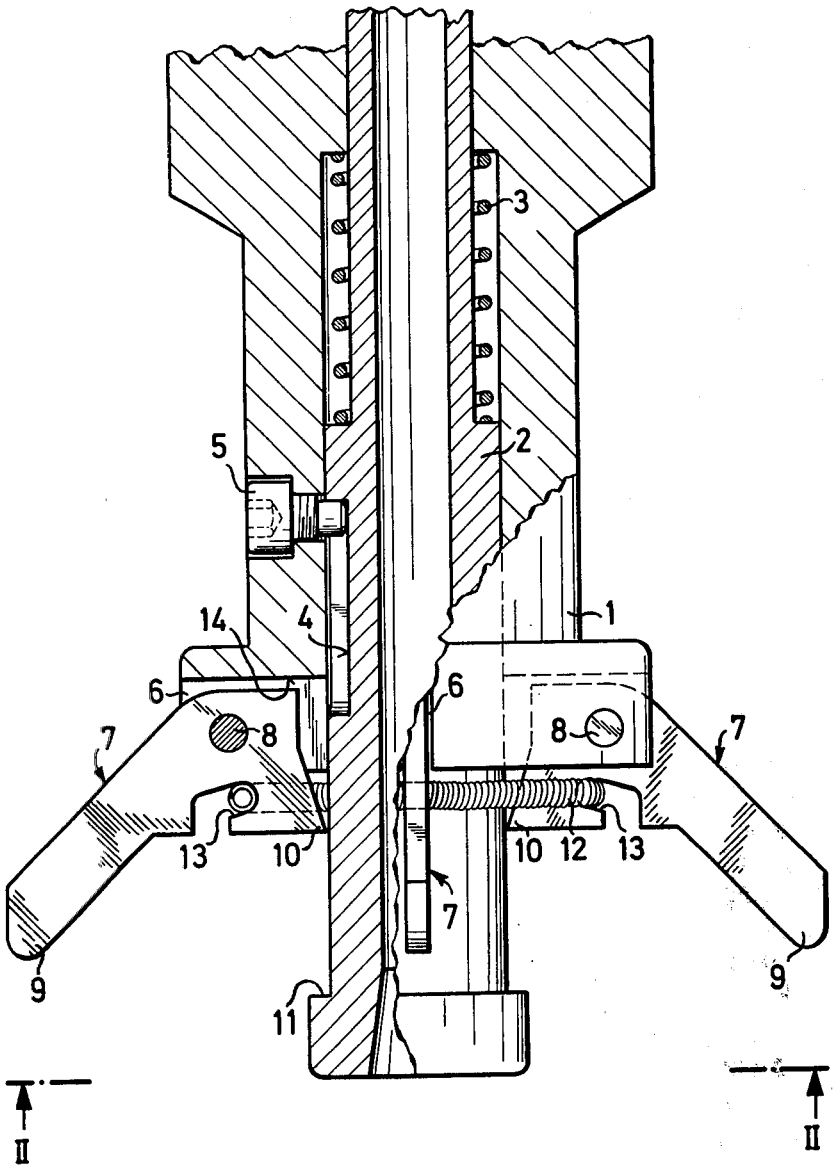
FIG. 1 is a partial side view of the forward end of a setting gun embodying the present invention, shown partly in section.
Figure 2:
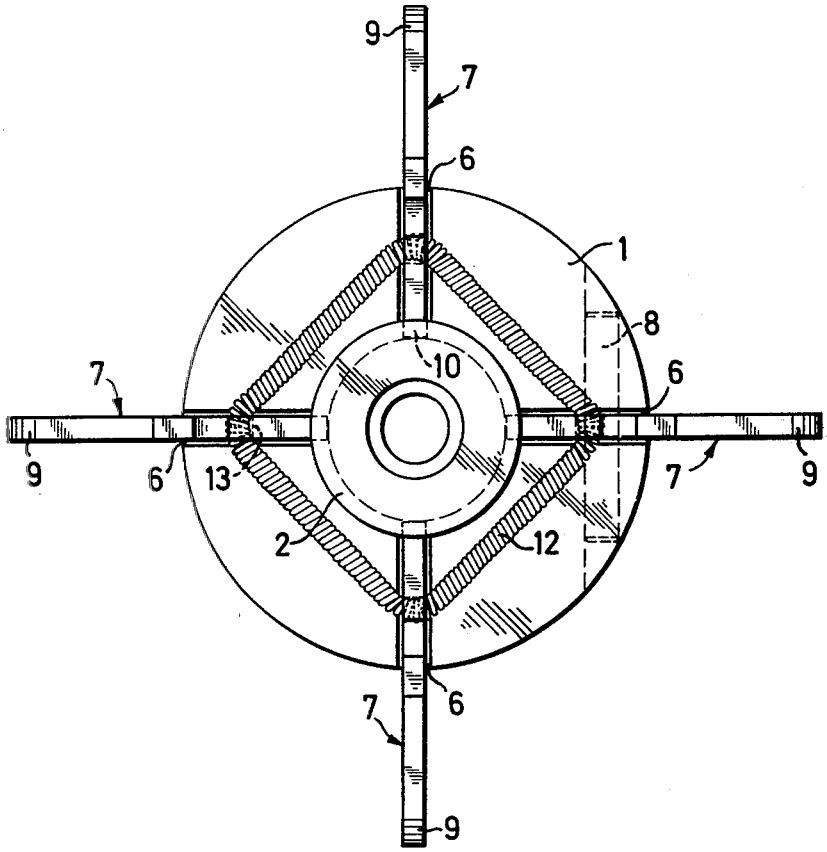
FIG. 2 is a front view of the forward end of the setting gun shown in FIG. 1.

FIG. 1 illustrates the forward end of a setting gun used for driving fastening elements into a receiving material by means of an explosive charge. The setting gun includes a housing 1 having an axially extending open space within which a barrel 2 is axially displaceably mounted. A compression spring 3 bears at one end against a shoulder on the housing and at the other end against a shoulder on the barrel and biases the forward or muzzle end of the barrel outwardly from the housing into a forward or non-firing position. To limit the displaceability of the barrel in the forward direction, an axial groove 4 is provided in the outer surface of the barrel which is engaged by a threaded pin 5 positioned within the forward end of the housing. In the front end of the housing, that is, the end facing in the firing direction, four equiangularly spaced slots 6 are provided, note FIG. 2, and a sensing element 7 is secured within each of the slots by means of a pivot 8. The elements 7 are formed as swivel levers for pivotal movement about the pivots 8. Each element or swivel lever 7 is in the form of a two arm lever with one arm forming a sensing finger 9 and the other arm forming a catch 10. Each arm of the swivel levers forming the catch 10 extends radially inwardly from the pivot toward the barrel axis. The levers are pivotally displaceable from a forward position, as shown in FIG. 1, to a rearward position. In the forward position, each catch 10 bears against the outer surface of the barrel and prevents the rearward displacement of the barrel into the firing position by forming a locking or blocking action with the shoulder 11, located slightly rearwardly of the muzzle end of the barrel. It can be appreciated that the shoulder 11 on the barrel must be displaced rearwardly from the position of the catch 10 shown in FIG. 1 in order to establish the barrel in the firing position of the setting gun. The opposite or radially outer surface of each arm forming a catch 10 has a recess 13, the opening to which faces outwardly, and within which a ring-shaped tension spring 12 is seated. The tension spring 12 provides a biasing action directing the catches 10 inwardly toward the barrel. The rearward surface of the slots 6 each form a stop 14 for limiting the movement of the swivel levers 7.

As mentioned, the setting gun, as shown in FIG. 1, is in the non-firing position and the swivel levers 7 are in the forward position due to the biasing action of the tension spring 12. If the muzzle end of the barrel of the setting gun is pressed against the surface of a receiving material, initially the barrel is moved rearwardly against the force of spring 3. As the barrel moves rearwardly, the forward ends of the sensing fingers 9, which extend forwardly and radially outwardly from the point of pivot attachment to the housing, contact the surface of the receiving material. As each of the sensing fingers 9 contact the surface of the receiving material the levers 7 rotate about the pivots 8 against the biasing force of the tension springs. As each lever pivots, its catch 10 is lifted off the surface of the barrel and it is displaced radially outwardly out of the rearward path of movement of the shoulder 11. The barrel 2 can be fully displaced into the firing position when each of the swivel levers has been pivoted by contact with the receiving material. If one of the swivel levers 7 does not contact the receiving material, its catch 10 remains in contact with the barrel surface and engages the shoulder 11 preventing the barrel from being displaced fully into the firing position. As long as one of the catches continues to block the rearward movement of the barrel the setting gun is maintained in the non-firing position and a cartridge or explosive charge cannot be fired. Accordingly, a simple positive locking action is provided for the barrel which assures that fastening elements will not be fired into the receiving material if the axis of the barrel is located too close to an edge surface of the receiving material.

While a specific embodiment of the invention has been shown and described in detail to illustrate the application of the inventive principles, it will be understood that the invention may be embodied otherwise without departing from such principles.

I claim:

1. A setting gun for driving fastening elements into a receiving material by means of an explosive charge, comprising a housing, a barrel having a muzzle end from which the fastening elements are driven and a rearward end, said barrel mounted within said housing and axially displaceable rearwardly therein from a position where the gun cannot be fired to a firing position by pressing the muzzle end of the barrel against the receiving material into which the fastening element is to be driven, at least one element located adjacent the muzzle end of said barrel and displaceably from a blocking position located within the range of movement of said barrel rearwardly from its non-firing position into its firing position and a release position for establishing the firing position of said barrel, characterized in that said element includes a catch, said barrel has a laterally outwardly extending shoulder located forwardly toward the muzzle end of the gun from said catch, sid catch located in the path of said shoulder or said barrel between the non-firing and firing positions to prevent the barrel from being displaced into its firing position when the element is in the blocking position, and in the release position of said element said catch being displaced out of the path of said shoulder so that the barrel can be displaced into the firing position.

2. A setting gun, as set forth in claim 1, wherein said element is a swivel lever pivotally mounted on said housing for movement between its blocking and release positions.

3. A setting gun, as set forth in claim 2, wherein said swivel lever is a two arm lever with the two arms arranged angularly to one another and with the pivot axis being located at the junction of said arms.

4. A setting gun, as set forth in claim 3, wherein the pivot axis of said swivel lever is located radially outwardly from said barrel, one of said arms forms said catch and extends radially inwardly from the pivot axis toward said barrel and the other said arm extends radially outwardly from the pivot axis and angularly forwardly therefrom toward the muzzle end of said barrel.

5. A setting gun, as set forth in claim 4, wherein said arm forming said catch by pressing contact against the receiving material into which the setting gun is to drive a fastening element, is pivotally displaceable out of the rearward path of movement of the shoulder on said barrel so that said barrel can be displaced into the firing position.

6. A setting gun, as set forth in claim 4, wherein said housing forms a stop in the path of movement of said swivel lever from the blocking position for defining the limit of the displaced position of said swivel lever from the blocking position.

7. A setting gun, as set forth in claim 4, wherein a spring element is associated with said swivel lever for biasing said swivel lever into the blocking position.

8. A setting gun, as set forth in claim 7, wherein said spring element comprises a ring-shaped closed tension spring encircling said barrel.

9. A setting gun, as set forth in claim 4, wherein four equiangularly spaced slots are formed in said housing and said slots open from the forward end of said housing and extend in the axial direction of said barrel into said housing, the forward end of said housing is located rearwardly from the muzzle end of said barrel when the barrel is in the non-firing position, one said swivel lever is pivotally mounted within each said slot with each of the arms of said swivel lever extending out of said slot toward the muzzle end of said barrel from the point of pivotal attachment to said housing, the other said arm which extends radially outwardly from the pivot axis having a free end extending forwardly from said slot and located in the firing position of said barrel rearwardly of its position when said barrel is not displaced rearwardly in said housing, each said swivel lever having a recess formed in said arm forming said catch with the opening in the recess facing outwardly away from said barrel, and a ring-shaped closed tension spring encircling said barrel and seated into the recess in the catch of each said swivel lever for biasing said swivel lever into the blocking position so that said catch bears against the outer surface of said barrel.

* * * * *